US006644280B2

(12) United States Patent
Rodriguez-Amaya et al.

(10) Patent No.: US 6,644,280 B2
(45) Date of Patent: Nov. 11, 2003

(54) METHOD FOR INJECTION FUEL, WITH MULTIPLE TRIGGERING OF A CONTROL VALVE

(75) Inventors: Nestor Rodriguez-Amaya, Stuttgart (DE); Anja Melsheimer, Stuttgart-Vaihingen (DE); Volker Reusing, Stuttgart (DE); Volker Leifert, Charleston, SC (US)

(73) Assignee: Robert Bosch GmbH, Stuttgart (DE)

( * ) Notice: Subject to any disclaimer, the term of this patent is extended or adjusted under 35 U.S.C. 154(b) by 27 days.

(21) Appl. No.: 09/976,051

(22) Filed: Oct. 15, 2001

(65) Prior Publication Data

US 2002/0083919 A1 Jul. 4, 2002

(30) Foreign Application Priority Data

Oct. 17, 2000 (DE) ..... 100 51 343

(51) Int. Cl.[7] ..... F02M 57/02

(52) U.S. Cl. ..... 123/447; 123/446; 123/467

(58) Field of Search ..... 123/300, 299, 123/446, 447, 467, 490, 498; 310/316.03, 317

(56) References Cited

U.S. PATENT DOCUMENTS

| | | | | |
|---|---|---|---|---|
| 3,575,146 A | * | 4/1971 | Creighton | 123/299 |
| 3,927,652 A | * | 12/1975 | O'Neill | 123/447 X |
| 5,101,797 A | * | 4/1992 | Sturz et al. | 123/496 |
| 6,147,433 A | * | 11/2000 | Reineke et al. | 310/316.03 |

* cited by examiner

*Primary Examiner*—Tony M. Argenbright
(74) *Attorney, Agent, or Firm*—Ronald E. Greigg

(57) ABSTRACT

The invention relates to a method for injecting fuel, which is at high pressure, into air-compressing internal combustion engines employing an injection system which includes a compressor unit for compressing fuel and containing an actuating device for control valves with which device the nozzle needle of an injector is controlled. One of the two control valves is triggered multiple times or in clocked fashion via a piezoelectric actuator during individual injection phases or during the injection cycle.

8 Claims, 4 Drawing Sheets

METHOD FOR INJECTION FUEL, WITH MULTIPLE TRIGGERING OF A CONTROL VALVE

BACKGROUND OF THE INVENTION

1. Field of the Invention

A wide range of air-compressing internal combustion engines that are used to drive utility vehicles exists. Different demands are made of the fuel injection systems of such internal combustion engines upon starting than when the engine is operating at its rated rpm. Yet in designing fuel injection systems, both demands must be met. Short triggering times of the control valves of an injection system are just as important as favorable production costs and a long service life of the injection system components, the latter being achieved by providing for a pressure equilibrium of the valve components.

2. Description of the Prior Art

Many variant embodiments of fuel injection systems are known. Examples that can be named are systems in which a piston with a restoring spring or some other pressure-generating component is provided. This component is preferably driven by a camshaft. In injection systems as a rule, a nozzle needle is provided, which moves between a lower or closing position and an upper position, and pressures are exerted in controlling fashion on the faces at the ends of the needle. As a rule, one or more control chambers are provided in such nozzle needles; furthermore, a nozzle needle is held in its lower position by a restoring spring.

Injection systems are also known that optionally include a fill diversion valve, which primarily controls the pressure in one of the control chambers of the nozzle needle, and also include a nozzle control valve, which primarily controls the pressure in the outlet of a further control chamber of the nozzle needle. Both of these valves can be embodied so that they can be switched either in coupled fashion or separately, and either electromagnetic, piezoelectric or magnetostrictive actuators can be employed. The valves can be actuated either directly or indirectly, and the valves can be both preceded upstream by throttle elements and followed downstream by throttle elements.

A fuel injection system which controls the pressure in the outlet region of a control chamber surrounding the nozzle needle is known from European Patent Disclosure EP 0 823 550 A1. The fundamental disadvantage of this arrangement will be described briefly now. At very low engine rpm, for instance upon starting of an internal combustion engine, the piston generates a pressure that is above the pressure level at which the sum of all the pressure forces on the nozzle needle just barely exceeds the force of the nozzle restoring spring. To make the pressure buildup possible, both valves are initially closed. At a certain time, however, the nozzle control valve is opened, causing the pressure in the corresponding control chamber to drop, and the sum of the forces on the nozzle needle bring about a motion of the nozzle needle in the direction of the upper position. By means of the nozzle that opens in the direction of the cylinder and by means of the opened nozzle control valve, a quantity of fuel now flows out that is greater than the quantity of fuel replenished at the piston. As a result, the pressure in the other control chamber of the nozzle needle drops, and this nozzle closes again, which is unwanted.

U.S. Pat. No. 5,819,704 discloses a remedy for the unwanted closure of the nozzle when the fuel volume flowing out is excessive. In this variant embodiment, the nozzle needle is equipped with a second seat. The second seat closes off the outflow from a first control chamber. In addition, by the suitable selection of throttle faces and pressure faces, it is attained that the pressure in the control chamber rises slowly, and beyond a certain pressure level, the nozzle needle lifts up just before reaching the upper position. This brief lifting up causes the pressure in the control chamber to drop immediately again, so that the injection is unimpaired. A disadvantage of this configuration of a nozzle needle with a second seat is, first, that a double-seat valve is more complicated and expensive to produce. Second, in this configuration the injection cannot be terminated at any arbitrary instant.

OBJECT AND SUMMARY OF THE INVENTION

The advantages that can be attained with the embodiment according to the invention are considered to be above all that when a piezoelectric actuator is used, the briefest possible valve triggering times are feasible; because of its substantially shorter reaction times, a piezoelectric actuator is superior to electromagnetic actuators. Clocking of the actuator positioning signal, when a piezoelectric actuator is used, is converted virtually directly into a clocked motion of the triggered control valve or control valves. With electromagnets, it is not feasible to convert the trigger signal directly into adjusting motions of the control valves acted upon, and so the clock signal would be wrong, and inappropriate courses of motion would ensue.

With the method proposed according to the invention, because of the short response times of the actuating devices used, it is possible to perform a multiple, clocked triggering of the nozzle control valve, so that upon starting of an internal combustion engine, an adequate quantity of fuel can be injected. Unwanted closure of the nozzle needle precisely during the starting phase, as can happen in the embodiments sketched above in the background section, is precluded in the method proposed according to the invention, because of the fast response times. By clocked opening and closing of the nozzle control valve during the injection event, the quantity of leakage at medium rpm is reduced. The result is an increase in the peak pressure or in the injection quantity, for the same total duration of triggering the control valves. With the method proposed according to the invention, thanks to the maximally short valve control times achieved by the piezoelectric actuator, the efficiency of the nozzle control valve can be increased. If at medium rpm of an internal combustion engine used in a utility vehicle, the nozzle control valve is opened and closed in clocked fashion during the injection event, then the resultant leakage can be reduced, and a better degree of filling of the particular combustion chamber of an internal combustion engine can be attained. The peak pressure and the injection quantity both increase at medium rpm of the engine, so that the thermodynamic variables that affect the efficiency have a positive development.

At the rated rpm, for which an internal combustion engine is as a rule designed, the same positive effect of a small leakage quantity can be attained if the nozzle control valve is briefly opened and closed multiple times. At rated rpm, with a brief opening and closure of the nozzle control valve and with the fill diversion valve kept closed, improved filling of the combustion chambers of the engine is attainable, which increases efficiency by improving fuel utilization.

BRIEF DESCRIPTION OF THE DRAWINGS

The invention will be better understood and further objects and advantages thereof will become more apparent from the ensuing detailed description of preferred embodiments taken in conjunction with the drawings, in which.

DESCRIPTION OF THE PREFERRED EMBODIMENTS

Figure 1:
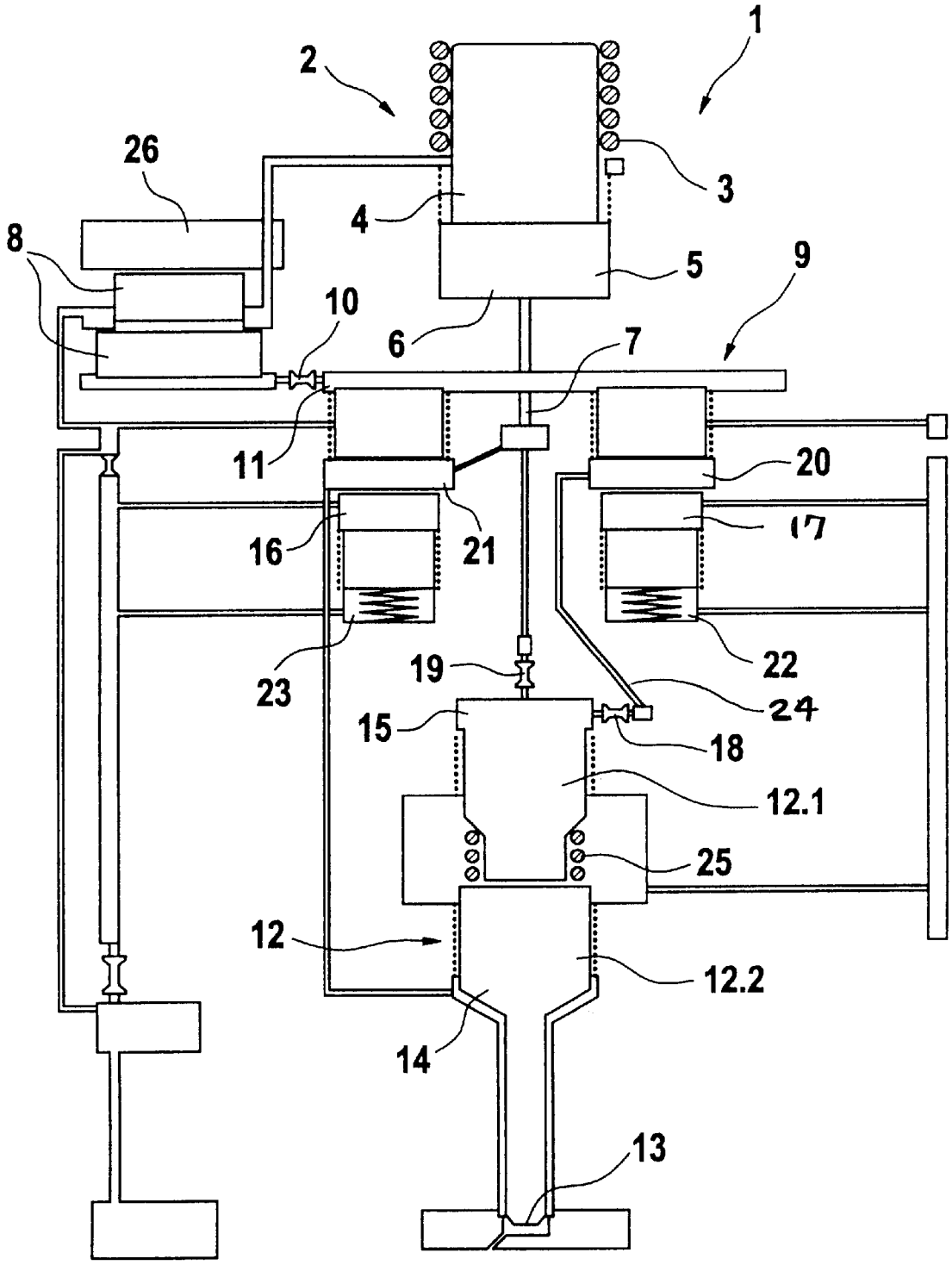
FIG. 1 shows the layout of an injection system actuatable by means of a piezoelectric actuator.

FIG. 1 shows an injection system, actuatable by means of a piezoelectric actuator, for an air-compressing internal combustion engine.

Reference numeral 1 indicates the injection system, which includes a compressor unit 2, shown schematically here. The compressor unit 2 as shown in FIG. 1 is embodied as a cylindrical piston pump, whose piston 4, acted upon by a spring element 3, compresses a fuel supply 6 received in a container 5. The compressed fuel supply is carried via a pressure line 7 to an injector housing, which is meant to receive a nozzle needle 12 on the tip of which an injection nozzle 13 is embodied that protrudes into the interior of a combustion chamber of an internal combustion engine.

In FIG. 1, a schematic illustration is provided of an actuating element, embodied as a piezoelectric actuator 8, which acts on a hydraulic coupler 9 that acts jointly on a first control valve 16 and on a second control valve 17. The hydraulic coupler 9 is embodied as a coupling chamber 11, which can be acted upon by the piezoelectric actuator via an intervening throttle element 10. The two upper end faces of the first control valve 16, which serves as a fill diversion valve, and the end face of the second control valve 17, which is embodied as a nozzle control valve, are acted upon via the coupling chamber 11, so that the valve bodies, not shown in further detail here but received in the respective valves, can be actuated in the vertical direction.

The nozzle needle 12, received in the injector housing of a fuel-injecting injector, can be embodied for instance as a two-piece nozzle needle, which includes both an upper part 12.1 and a lower part 12.2. An upper control chamber 15 is embodied in the upper region of the nozzle needle 12, while the lower part 12.2 of the nozzle needle 12 is surrounded by a nozzle chamber 14. The nozzle chamber 14 of the nozzle needle 12 can be pressure-relieved via a relief line into the valve chamber 21 embodied in the fill diversion valve 16. The control chamber 15, embodied in the upper part 12.1 of the nozzle needle 12, communicates, via a supply line in which an inlet throttle 19 is embodied, with the container 5 and can be pressure-relieved via an outflow line 24, in which an outflow throttle 18 is embodied, and via the nozzle control valve 17.

Each of the two control valves 16 and 17 is assigned a respective restoring element 22 and 23, on the side opposite the coupling chamber 11; in the embodiment of FIG. 1, this restoring element is embodied as a spiral spring. A tapering portion of the upper part 12.1 of the nozzle needle 12, in the embodiment of the nozzle needle shown in FIG. 1, is surrounded by a spring element 25, and the upper part 12.1 and lower part 12.2 of the nozzle needle 12 are received in the housing of the injector essentially coaxially in alignment with one another. Reference numeral 26 indicates the trigger means, which is associated with the piezoelectric actuator 8 that accomplishes the exertion of pressure on the coupling chamber 11, common to the two control valves 16 and 17, with a control volume. By suitable changes in voltage or current at the actuator control 26, different vertical stroke motions can be established at the piezoelectric actuator, so that the control volume received in the hydraulic coupler 9 is exposed to different pressures, and thus as a function of the restoring elements 22, 23, different stroke paths are achieved at the two control valves 16 and 17, respectively.

FIGS. 2*a*–2*d* show more details of the injection parameters of an injection sequence which proceeds at a rotary speed of a pump of 30 rpm during the starting phase.

In the sequence of graphs in FIGS. 2*a*–2*d,* the pressure courses, signal courses, and resultant paths of the injection system, which proceed in parallel, are compared with one another at identical times. Reference numeral 27 indicates the course of the trigger signal of the piezoelectric actuator 8, which in terms of FIG. 1 is imposed on the piezoelectric actuator 8 by the trigger means 26, as a result of the voltage or current change that takes place there. The trigger signal, shown here as square voltage pulses, results in a course of pressure in the coupling chamber 11 that is exerted on the two control valves 16 and 17, as represented by the course of the curve 28.

Figure 2A:
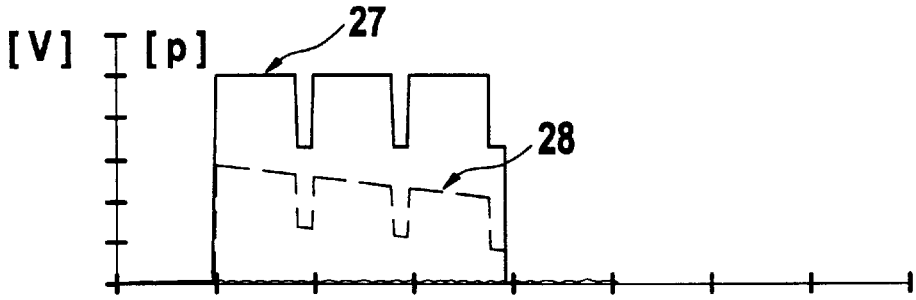
FIGS. 2*a*–2*d* show the course of the injection parameters in an injection sequence, at a rotary speed of the pump of 30 rpm.
Figure 2B:
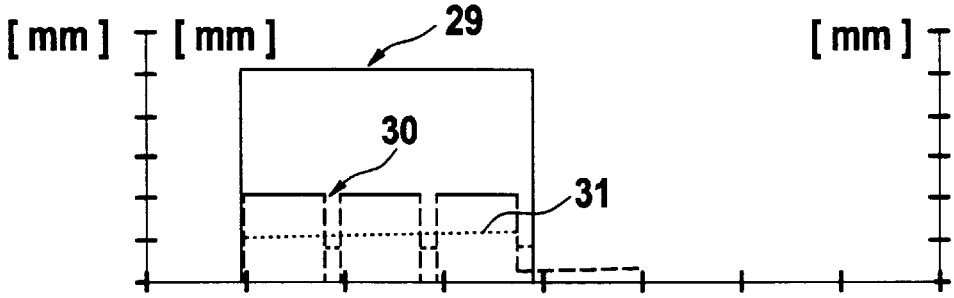

FIG. 2*b* shows that the fill diversion valve 16 remains closed, in accordance with curve 29, while it can be seen from curve 30, which represents the stroke path of the nozzle control valve 17, that this valve is opened and closed multiple times in succession, in order to furnish a cumulative injection quantity that is adequate for starting the engine. The stroke of the actuator piston resulting from the actuator 8 as represented by the curve 27 is indicated by reference numeral 31. FIG. 2*b* shows that the actuator stroke 31 has a course that is proportional to the actuator trigger signal 27 of the actuator trigger means 26.

Figure 2C:
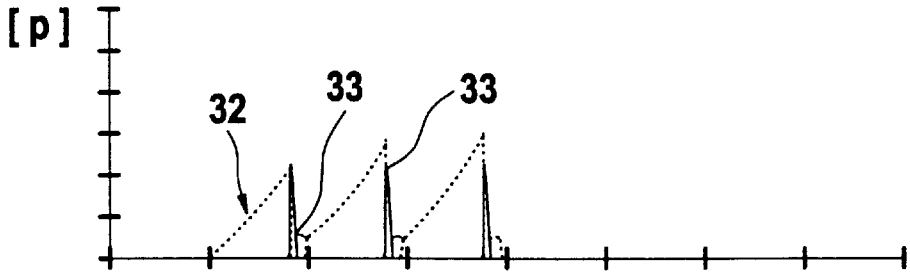

In accordance with the clocked opening and closure of the nozzle control valve 17 represented by the stroke path 30 in FIG. 2*b,* a sawtooth course of the injection pressure 32 occurs, as shown in FIG. 2*c*. Reference numeral 33 indicates the pressure course in the upper control chamber 15 of the nozzle needle 12, which runs essentially parallel to the gradient of the injection pressure during the injection phase.

Figure 2D:
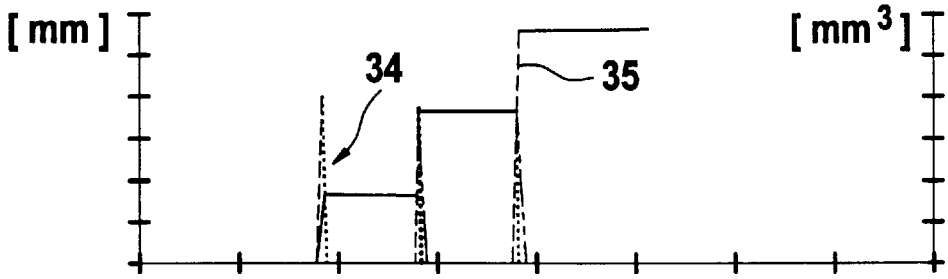

In the view of FIG. 2*d,* the cumulative increase in the injection quantity that can be attained by clocked triggering of the nozzle control valve is plotted over the time axis and can be seen from curve 35. By clocked injection of what always remain the same partial injection quantities, after multiple successive opening and closure of the injection nozzle 13, the result is a graduated cumulative quantity of fuel injected into the combustion chamber of an engine. Since in terms of the trigger signal 27 in FIG. 2*a,* the trigger times by the actuator 8 always remain the same, the partial volume of injection quantities contributed per clocking, that is, the opening and closing interval of the control valve 17, always remains the same, so that after a number of successive events of opening and closing the first control valve, the result is the curve 35 in FIG. 2*d*.

FIGS. 3*a*–3*d* show the course in more detail of the injection parameters of an injection sequence which is plotted at a rotary pump speed of about 500 rpm, which is equivalent to a medium rpm of internal combustion engines.

From the course of the positioning signal 27 of the piezoelectric actuator in FIG. 1, it can be seen that the piezoelectric actuator 8 is now switched in clocked fashion. Accordingly, there is a clocked pressure course, represented by reference numeral 28, in the coupling chamber 11. Reference numeral 37 in FIG. 3*a* indicates a pressure peak in the valve chamber 20 of the nozzle control valve 17. Extending parallel, on the time axis, to the trigger signal 27 or the pressure course 28 in the coupling chamber 11 are the resultant stroke paths 29 and 30 of the fill diversion valve 16 and the nozzle control valve 17 as plotted in FIG. 3*b*. The clocked triggering events of the actuator are expressed directly in the course of the stroke path 30 of the nozzle control valve 17, which viewed in the vertical direction, because of the clocked triggering by the piezoelectric actuator 8, executes strokes of a few hundredths of a millimeter. The course of the actuator stroke 31 approaches a closed curve.

Figure 3A:
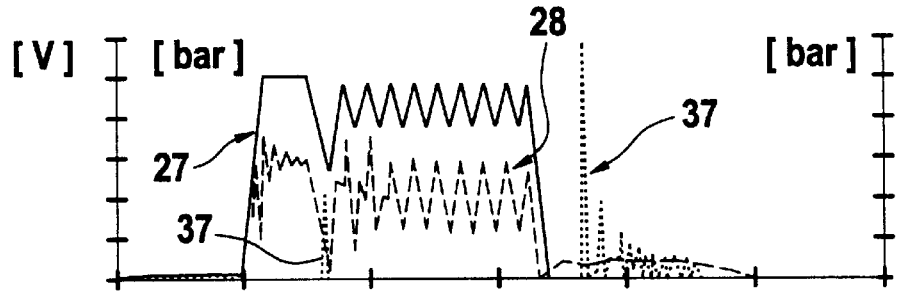
FIGS. 3*a*–3*d* show the course of the injection parameters in an injection sequence, at a rotary speed of the pump of 500 rpm, in other words a medium rpm.
Figure 3B:
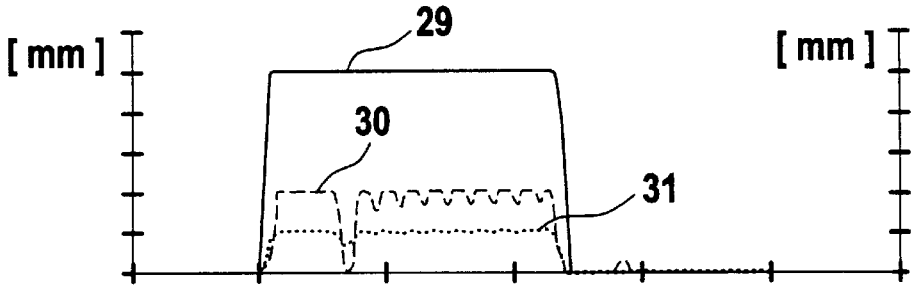
Figure 3C:
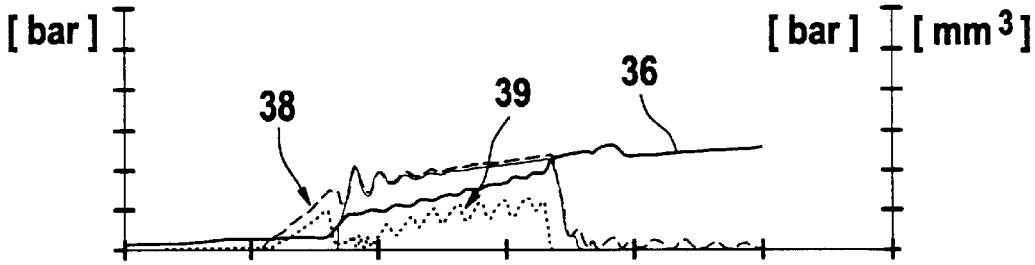

The graph in FIG. 3*c* shows the gradually rising leakage quantity, represented by reference numeral 36, at medium rpm, while reference numeral 39 indicates the pressure course in the control chamber 15 of the nozzle needle 12. By clocked actuation of the nozzle control valve 17 during the injection, the leakage quantity can be reduced and the injection quantity can be increased. As a result, better filling of the combustion chambers of the engine with fuel can be attained, and as a result, better utilization of the intrinsic internal energy in the fuel is assured.

Figure 3D:
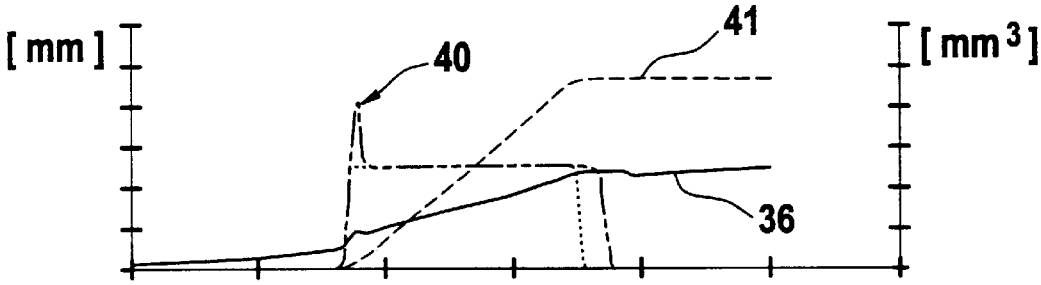

FIG. 3*d* shows the course 40 of the nozzle needle stroke, plotted over time, as well as the injection quantity 41, which increases continuously over time. In contrast to the vertical motion occurring in the control valves 16 and 17 which occurs in the range of hundredths of a millimeter, upon actuation of the injection nozzle vertical stroke motions on the order of magnitude of tenths of a millimeter occur at the nozzle needle, so as to assure the requisite volume of fuel at high pressure injected into the combustion chambers of an internal combustion engine.

From the sequence of graphs in FIGS. 4*a*–4*d*, the resultant injection parameters of an injection sequence at a rotary pump speed of 900 rpm can be seen in more detail; this corresponds to the rated rpm of an internal combustion engine.

Figure 4A:
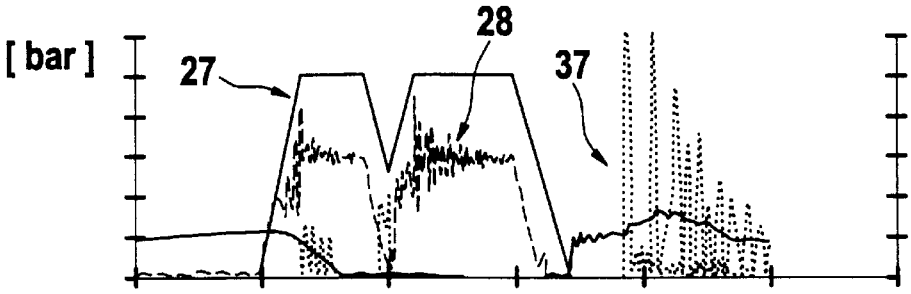
FIGS. 4*a*–4*d* show the resultant injection parameters in an injection sequence, at a rotary speed of the pump of 900 rpm, which is the design rpm for an internal combustion engine.
Figure 4B:
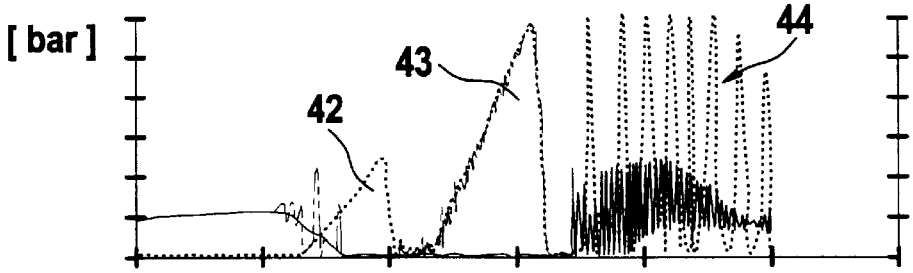
Figure 4C:
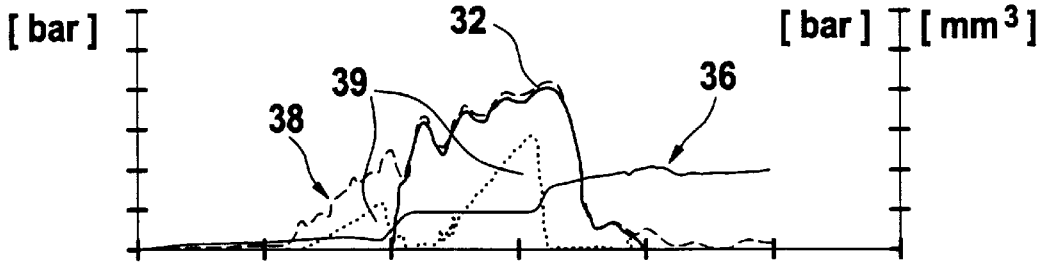
Figure 4D:
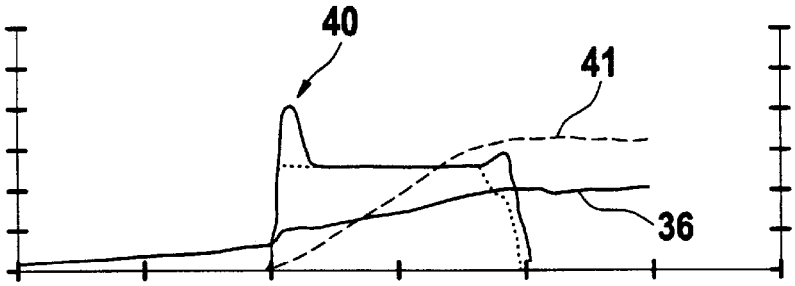

From the graph in FIG. 4*a*, the course of the actuator signal 27 and the resultant pressure course in the coupling chamber 11 is seen in greater detail. FIG. 4*b* shows the pressure courses 42 and 43 that result from the actuation of the actuator 8 and that essentially represent a preinjection 42 and an ensuing main injection 43. Reference numeral 44 designates pressure pulsations that can occur in the injection system 1 after the closure of the control valve 17. For the injection, once a buildup has taken place, the nozzle control valve 17 is opened briefly only once. In the control chamber 15, which is received above the nozzle needle 12, the pressure buildup after the re-closure of the nozzle control valve 17 takes place so slowly that the injection is not impaired. FIG. 4*c* shows the resultant pressure course 38 in the nozzle chamber of the nozzle needle 12, while conversely the pressure course in the control chamber is shown at 39. The curve 32 represents the approximately trapezoidally configured course of injection pressure during the injection phase at the injection nozzle 13. In FIG. 4*d*, the resultant nozzle needle stroke path 40 is shown, which after a brief overswing reaches a constant level and is held during the injection at this stroke level, so that a linearly rising injection quantity 41 as shown by the curve in FIG. 4*d* ensues. During the injection, which lasts for the duration of the open state of the nozzle needle, indicated in FIG. 4*d* by reference numeral 40, the injection pressure assumes the virtually trapezoidally configured course shown at 32 in FIG. 4*c*. This is a reproduction of the pressure level that ensues in the nozzle chamber, whose course is represented by reference numeral 38 in FIG. 4*c*.

By means of the method proposed according to the invention for injecting fuel into an air-compressing internal combustion engine, at different rpm levels and improvement in the degree of filling of the combustion chambers of an internal combustion engine can be attained by means of purposeful, clocked, multiple triggering of an actuator 8, which actuates the control valves 16 and 17, along with an increase in the peak pressure and an increase in the injected fuel quantity. At the same time, the incident stream of leaking oil is reduced, so that overall, with the method proposed according to the invention, improved fuel utilization in an internal combustion engine is obtained.

The foregoing relates to preferred exemplary embodiments of the invention, it being understood that other variants and embodiments thereof are possible within the spirit and scope of the invention, the latter being defined by the appended claims.

We claim:

1. A method for injecting fuel, which is at high pressure, into air-compressing internal combustion engines, the method comprising providing an injection system (1) which includes a compressor unit (2) for compressing fuel and an actuating device (8) for control valves (16, 17) with which the nozzle needle (12) of an injector is controlled, and triggering one or both of the control valves (16, 17) multiple times or in clocked fashion during individual injection phases or during the injection cycle, via a piezoelectric actuator (8), comprising keeping the control valves (16, 17) closed during the starting phase of the engine, at low mm of the compressor unit (2), and providing a brief opening of the valve functioning as a nozzle control valve (17) after the starting phase, wherein by multiple, clocked opening of the nozzle control valve (17), a cumulative injection quantity is furnished.

2. The method according to claim 1, wherein the first control valve (16) functions as a fill diversion valve, and the second control valve (17) functions as a nozzle control valve (17).

3. The method according to claim 2, further comprising switching the nozzle control valve (17) during the injection at medium rpm of the engine.

4. The method according to claim 3, wherein at medium rpm of the engine, the nozzle control valve (17) is opened and closed in clocked fashion during the injection.

5. The method according to claim 3, wherein by the development of a pressure stage when a predetermined pressure level is exceeded, an independent, automatic opening of the nozzle control valve (17) ensues.

6. A method for injecting fuel, which is at high pressure, into air-compressing internal combustion engines, the method comprising providing an injection system (1) which includes a compressor unit (2) for compressing fuel and an actuating device (8) for control valves (16, 17) with which the nozzle needle (12) of an injector is controlled, and triggering one or both of the control valves (16, 17) multiple times or in clocked fashion during individual injection phases or during the injection cycle, via a piezoelectric actuator (8), wherein by the development of a pressure stage when a predetermined pressure level is exceeded, an independent, automatic opening of a nozzle control valve (17) ensues.

7. The method according to claim 6, comprising keeping the control valves (16, 17) closed during the starting phase of the engine, at low rpm of the compressor unit (2), and providing a brief opening of the valve functioning as a nozzle control valve (17) after the starting phase.

8. The method according to claim 7, wherein by multiple, clocked opening of the nozzle control valve (17), a cumulative injection quantity is furnished.

* * * * *